US006651737B2

(12) United States Patent
Bouligny et al.

(10) Patent No.: US 6,651,737 B2
(45) Date of Patent: Nov. 25, 2003

(54) COLLAR LOAD SUPPORT SYSTEM AND METHOD

(75) Inventors: Vernon J. Bouligny, New Iberia, LA (US); Scott J. Arceneaux, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 170 days.

(21) Appl. No.: 09/769,044

(22) Filed: Jan. 24, 2001

(65) Prior Publication Data

US 2002/0096337 A1 Jul. 25, 2002

(51) Int. Cl.[7] ..... E21B 3/04; E21B 3/035

(52) U.S. Cl. ..... 166/52; 166/85; 166/203; 166/423; 464/163; 464/176

(58) Field of Search ..... 166/52, 85, 87, 166/202, 203, 423; 464/162, 163, 176

(56) References Cited

U.S. PATENT DOCUMENTS 3,857,450 A * 12/1974 Guier
4,791,999 A * 12/1988 Skeie
5,083,356 A * 1/1992 Gonzalez et al.
6,237,684 B1 * 5/2001 Bouligny et al.

* cited by examiner

*Primary Examiner*—Roger Schoeppel
(74) *Attorney, Agent, or Firm*—The Matthews Firm

(57) ABSTRACT

A wellbore tubular handling system and method is provided for operation in holding and lowering tubulars, such as tubing strings, casing strings, pipe strings, and the various components thereof, at a rig site. The handling system utilizes a shock table with a compressible support surface that compressively moves with a selected compression rate in response to the weight of the wellbore tubular string. The shock table preferably has a shock table body mounted below the rig floor and may conveniently replace the rotary table master bushing except for a flange which supports the shock table on the rig floor. A split-sectioned landing spear can be split open to an open position to thereby allow large items such as collars or other string components to pass through the shock table. In a closed position, the landing spear supports, preferably indirectly, an upper collar of the wellbore tubular string to thereby support the weight of the wellbore tubular string and apply the weight to the compressible support surface of the shock table.

35 Claims, 5 Drawing Sheets

COLLAR LOAD SUPPORT SYSTEM AND METHOD

BACKGROUND OF THE INVENTION

1. Field of the Invention

The present invention relates generally to inserting or running wellbore tubulars into a wellbore and, more particularly, to a collar load support system for picking up and lowering a wide size range of wellbore tubulars into the wellbore.

2. Description of the Background

Corrosion resistant alloy is useful in wellbore tubulars including casing, production tubing, and the like, to avoid premature failure of the wellbore tubulars in hostile environments. Severe corrosive action may occur in hostile environments such as deep, high pressure gas wells. Although such wells may be highly productive, they also tend to be expensive to drill and to workover. Therefore, these wells are suitable for extra precautions taken to extend the productive life thereof such as corrosion resistant alloy wellbore tubulars. Traditional procedures and hardware used to carry out installation of tubing may produce marks on corrosion resistant alloy wellbore tubulars because traditional procedures rely on toothed inserts or dies and gripping mechanisms that force the die or insert teeth radially inwardly against the pipe outer diameter. Ideally, complete elimination of the injurious die marks and associated necessary cold working for such tubulars would permit optimum performance of the corrosion resistant alloy, minimum cost of a string of corrosion resistant alloy, and the least weight thereof.

One wellbore tubular running system, which is disclosed in U.S. Pat. No. 5,083,356, issued Jan. 28, 1992, to Gonzalez et al., and which is incorporated herein by reference, teaches a method for non-abrasively running tubing. The method includes the steps of suspending the tubing from the face of the uppermost collar of the tubing by resting the face upon a support shoulder, making up a new tubular with a collar into a tubular unit, attaching a non-abrasive lift unit to a tubular unit, stabbing the new tubular into the upper collar, non-abrasively making the connection tight, and lifting the unit to raise the string.

The above wellbore tubular running system makes use of a shock table and landing spear that has several purposes. The landing spear engages the lifting unit, or load transfer sleeve, and is supported by the shock table. One of the purposes of the shock table is to reduce the dynamic effects of decelerating the tubing string. This deceleration occurs when the wellbore tubular string weight is transferred from the elevator to the shock table through a landing spear. If desired, the table compression rate may be provided in two stages although one stage could also be used. For example only of a two-stage system, from 0 to 60 tons, the load could be absorbed at a rate of 17.5 tons/inch and once the loading exceeds 60 tons, the compression rate could increase to 55 tons/in of deflection. Mechanical stops could be finally engaged at 160 tons. Essentially, the table compression rate increases the time span over which the load is applied regardless of the specific spring rates, the final mechanical stop and whether or not more than one stage of table compression rate is provided. The increased time interval significantly decreases the dynamic forces applied to the tubular coupling face as taught by the method.

One of the problems of the above wellbore tubular system is that, for practical purposes, the system is limited in the size of the wellbore tubulars, including variable size items in the tubular string, which can be readily inserted into the wellbore. It would be desirable to provide means that can be used that would allow couplings and other large items to pass through the shock table and landing spear with ease while still maintaining full functioning of the shock table and landing spear. Another problem of the wellbore tubular running system relates to the shock table and the amount of space it takes up thereby requiring personnel to work on elevated work platforms, scaffolding, and the like in the midst of rather heavy equipment. Working on elevated work platforms tends to be more confining, more prone to slow downs, with less room for personnel to avoid accidents.

Consequently, the above referenced prior art does not disclose means for eliminating the problems associated with existing non-abrasive wellbore tubular running systems. It would be desirable to provide a system suitable for running corrosion resistant alloy wellbore tubulars that permits more space on the rig floor. It would be highly desirable to allow the personnel to work on the rig floor rather than on scaffolding. As well, it would be desirable to provide such a system that is more flexible with respect to variations in wellbore tubular sizes, including casing, and permits couplings and large items to pass through the shock table and landing spear easily. Those skilled in the art have long sought and will appreciate the present invention which addresses these and other problems.

SUMMARY OF THE INVENTION

The present invention was designed to provide more efficient operation to thereby improve flexibility of operation and to reduce drilling costs due to decreased time required for using different size wellbore tubulars, collars, and pipe string components.

Therefore, it is an object of the present invention to provide an improved handling system for holding and lowering wellbore tubulars, especially a wide range of tubulars including pipes, production tubing, as well as large tubulars such as casing.

Another object of the present invention is to provide a handling system that is easier to operate and is safer for rig personnel.

A feature of the present invention is a split sectioned landing spear for which may be split open to allow a large item to easily pass.

These and other objects, features, and advantages of the present invention will become apparent from the drawings, the descriptions given herein, and the appended claims. However, the invention is not limited to these objects, features, and advantages.

Therefore, the present invention provides for a handling system for holding and lowering wellbore tubulars for use with a rig having a traveling block and a rig floor. The rig floor defines an opening therethrough for the wellbore tubulars. A plurality of collars is provided for interconnecting the wellbore tubulars. The system comprises a sleeve for engaging the plurality of collars and a landing spear for engaging the sleeve. A shock table is provided with a shock table body. A portion of the shock table body extends through the rig floor within the opening. The shock table comprises a compressible section with a compressible surface supported by the compressible section. The compressible surface supports the landing spear.

In a preferred embodiment, a radially outwardly extending member is secured to one end of the shock table body for engagement with the rig floor and for supporting the shock table within the opening. The radially outwardly extending member may preferably be a flange.

The landing spear is preferably pivotally mounted with respect to the compressible surface. The landing spear may comprise separable elements, wherein each of the separable elements may be pivotally mountable with respect to the compression surface. The landing spear has a base for engagement with the compression surface and may have a conical profile in one embodiment. The landing spear has an outer circumference and may be split into at least two sections with each of the two sections forming a portion of the outer circumference. A connection may be provided between the at least two sections and the compression table. The connection may be a pivotal connection to permit pivotal movement between the at least two sections and the compression table.

In one method of the present invention, steps are provided such as mounting a shock table within the opening in the rig floor such that a substantial portion of the shock table is below a surface of the rig floor. Other steps may include providing a landing spear for receiving a weight of the wellbore tubulars and providing a compressible surface for the shock table such that the compressible surface is moveable with respect to the rig floor in response to tension applied thereto through the landing spear. In one embodiment, a step is provided for pivotally interconnecting the landing spear with respect to the shock table.

In other words, one embodiment of the invention may include a shock table mountable with respect to the rig floor and a landing spear for supporting a weight of the wellbore tubulars transferred to the landing spear through the load transfer sleeve from respective of the plurality of collars. The landing spear may have at least two sections with each of the sections secured to the shock table by one or more connections that allow each of the sections to be moveable with respect to the shock table between a closed position and an open position. One or more of the connections may further comprise one or more hinges.

In operation, one embodiment of a method for a handling system for wellbore tubulars may provide steps such as the step of suspending a wellbore tubular string by supporting a weight of the wellbore tubular string on a load transfer sleeve that engages a downward face of an upper collar of the wellbore tubular string wherein the weight of the wellbore tubular string may be received by a landing spear. The landing spear preferably has two or more landing spear sections. Additional operational steps may include lifting an additional wellbore tubular via a load transfer sleeve for attachment to the wellbore tubular string, stabbing a pin end of the additional wellbore tubular into the upper collar, making the pin end and the upper collar connection tight, lifting the wellbore tubular string, and opening the landing spear by moving the landing spear sections radially outwardly with respect to the wellbore tubular string.

The method of operation may include compressing a compressible support surface in response to the weight of the wellbore tubular string at a selected rate of compression and pivotally attaching the landing spear with respect to the compressible support surface. In a preferred embodiment, the method further comprises mounting a shock table body for supporting the compressible support surface such that at least a portion of the shock table body is mounted beneath a rig floor.

DETAILED DESCRIPTION OF THE PREFERRED EMBODIMENTS

Figure 1:
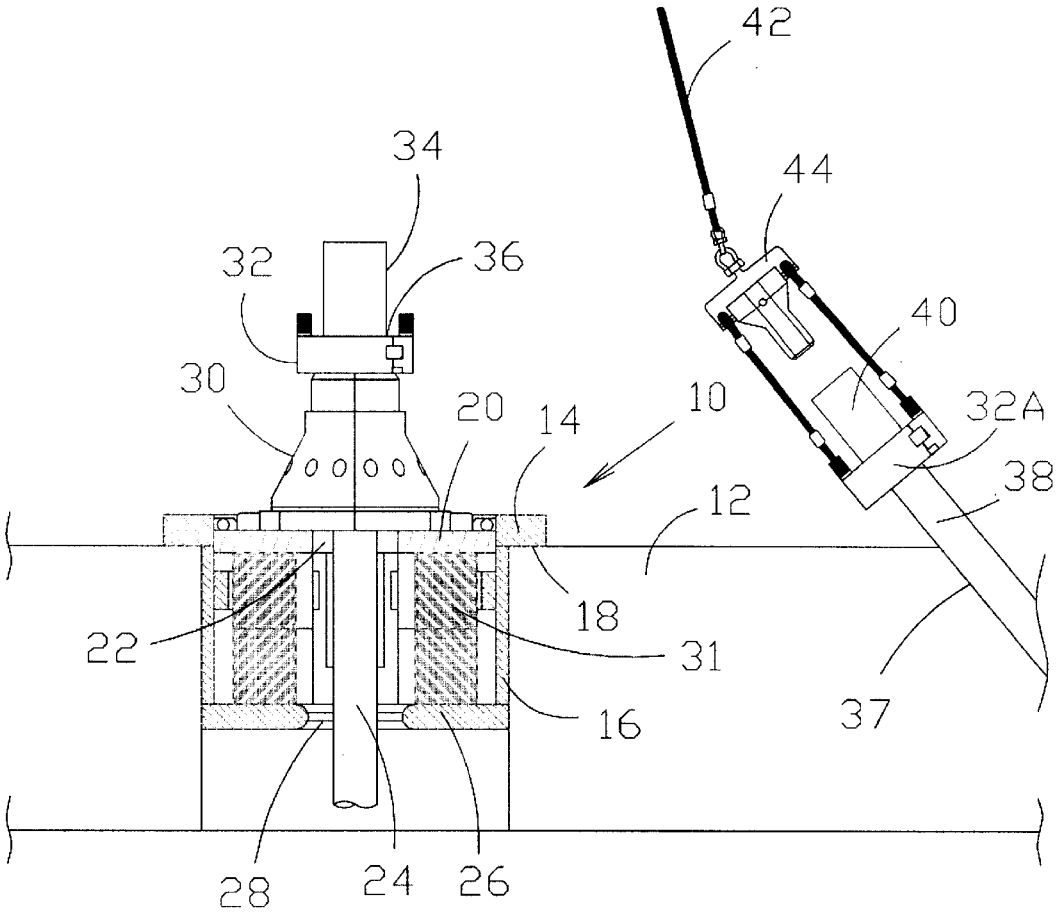
FIG. 1 is an elevational view, partially in section, of a shock table mounted within a rig floor and a load transfer sleeve used for lifting wellbore tubulars.

Referring now to the drawings, and more specifically to FIG. 1, there is shown shock table 10 mounted within rig floor 12. In one preferred embodiment, shock table 10 may be positioned within the rotary table in the position of the rotary table master bushing. Shock table 10 includes a radially outwardly extending member such as flange 14 which extends radially outwardly from shock table body 16. Flange 14 engages an upper surface 18 of rig floor 12 thereby preventing further downward movement of shock table 10 with respect to rig floor 12.

Support platform 20 is moveable within shock table body 16 upwardly and downwardly. As shown in FIG. 1, support platform 20 is in a compressed position such that it has moved downwardly with respect to rig floor 12 due to the weight of wellbore tubular string 24. Directions such as upwardly, downwardly, outwardly, and the like are intended to provide easy understanding of the invention with respect to the attached figures and should not be construed in any way as limiting the invention. It will be understood that various relative positions of the components may be used during transportation, assembly and the like. Compression platform 20 is preferably but not necessarily circular and preferably is guided by a corresponding cylindrical interior of shock table body 16. Compression platform 20 defines bore 22 therein for receiving wellbore tubular string 24 therethrough. Body 16 preferably has a lower support surface 26 which also defines a bore 28 therethrough for receiving wellbore tubular string 24. Compressible section 31 is contained within body 16 and lower support surface 26. Compressible section 31 may comprise cylinders such as independent elastomer cylinders or other types of compressible cylinders to provide a spring-like effect. Compressible section 31 engages compression platform 20 and is compressed as compression platform 20 moves downwardly within body 16. In a presently preferred embodiment, compression section 31 be designed to provide a constant compression rate for decreasing dynamic forces. However if desired, a two-stage compression rate for decreasing dynamic forces could also be used.

Landing spear 30 is supported by compression platform 20. Landing spear 30 engages load transfer sleeve 32 which engages the lower face 36 of coupling 34. Lower face 36 and load transfer sleeve 32 support the weight of wellbore tubular string 24. A second load transfer sleeve 32A is attached to wellbore tubular 38 and engages the face of collar 40 as wellbore tubular 38 is lifted. Pick-up line 42 attaches to hanger 44 for lifting tubular 38 onto rig floor 12. Tubular 38 may rest on V-door 37 which leads to rig floor 12 from the rig catwalk.

Figure 2:
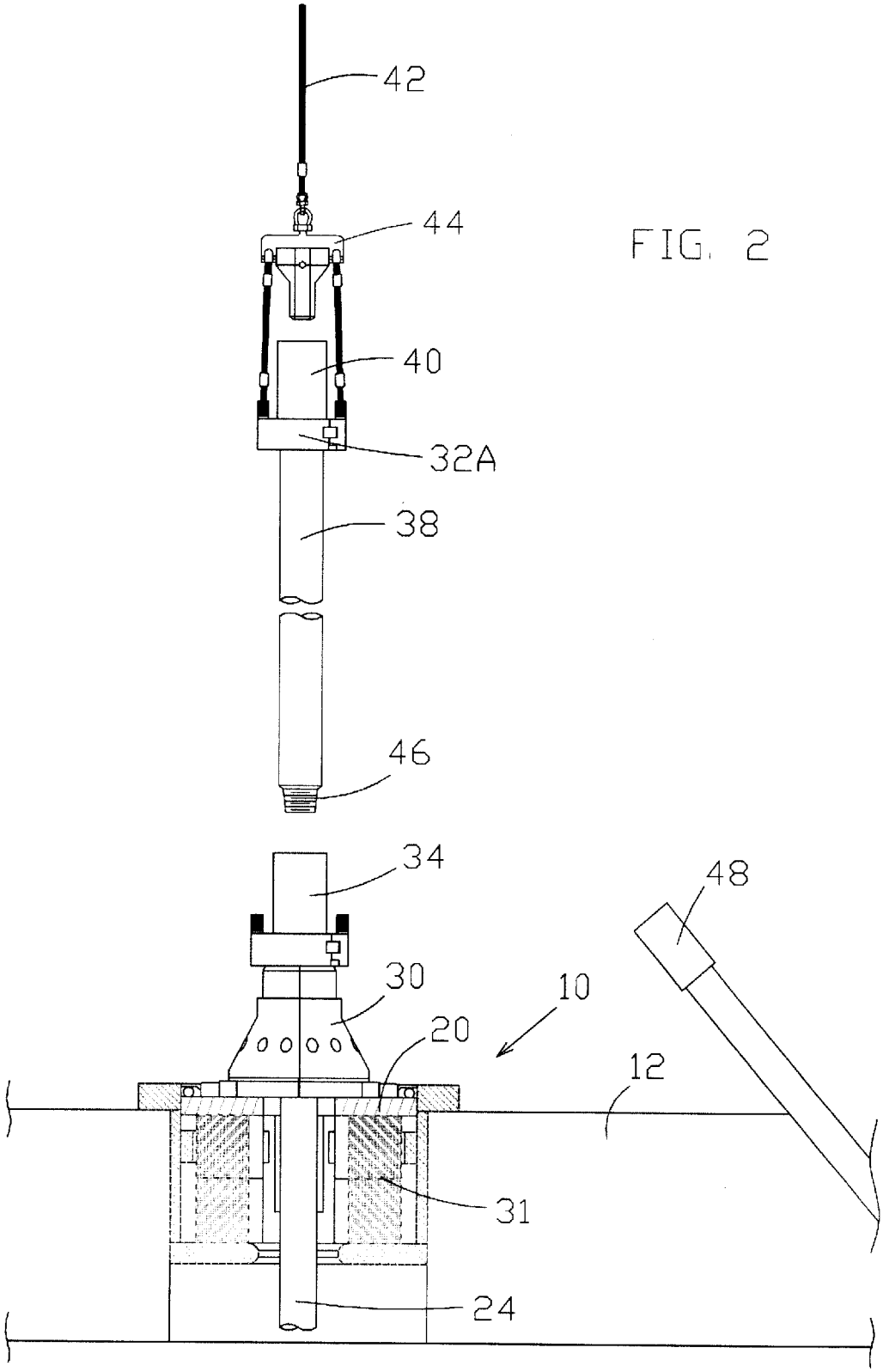
FIG. 2 is an elevational view, partially in section, of the wellbore tubular of FIG. 1 being stabbed into the tubular string.

In FIG. 2, wellbore tubular 38 has been raised above rig floor 12 so that the threads of pin 46 may be stabbed into and threadably connected to collar 34. In this way, each wellbore tubular 38 is made part of wellbore tubular string 24. FIG. 2 also shows another subsequent wellbore tubular 48 available for attachment to wellbore tubular string 24. Therefore, wellbore tubular string 24 may, if desired, be run into the wellbore one joint at a time. Thus, FIG. 2 discloses a step in the operation of the present invention.

Figure 3:
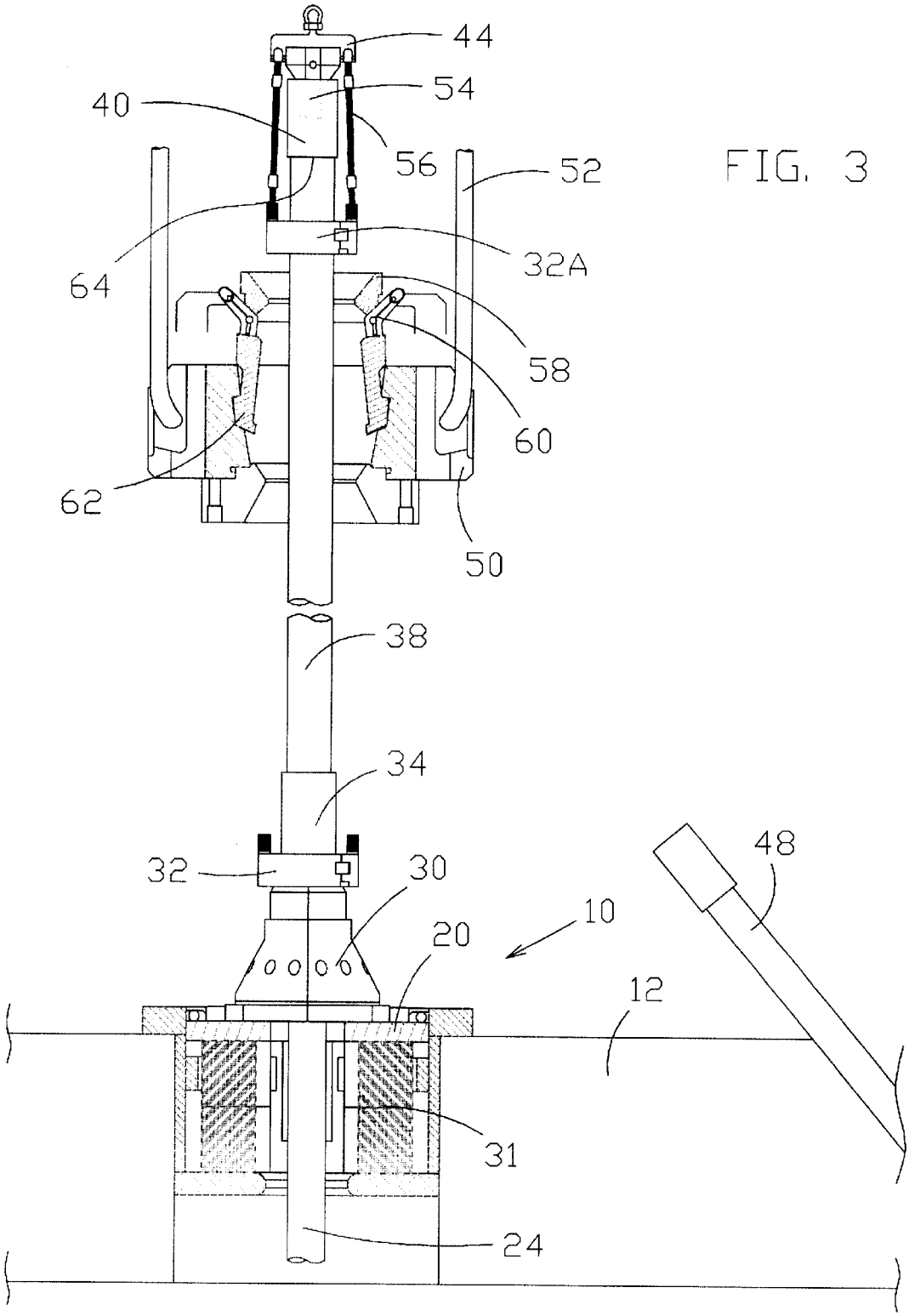
FIG. 3 is an elevational view, partially in section, of the elevator lowered over the wellbore tubular of FIG. 1 which has been made up into the wellbore tubular string.

Referring to FIG. 3, once wellbore tubular 38 is secured to wellbore tubular string 24, then elevator 50 may be lowered over wellbore tubular 38. Elevator 50 is secured to the traveling block of the rig by bails 52. Hanger 44 preferably includes a plug section 54 that insertably engages collar 40. Load transfer sleeve 32A may drop down away from collar 40 during this stage of operation as shown in FIG. 3 after pick-up line 42 is disconnected from hanger 44 but remains supported by slings 56 attached to hanger 44. Top guide 58 and leveling beam 60 are used to guide load transfer sleeve 32A into elevator slips 62 for lifting wellbore tubular string 24 which now includes tubular 38.

Figure 4:
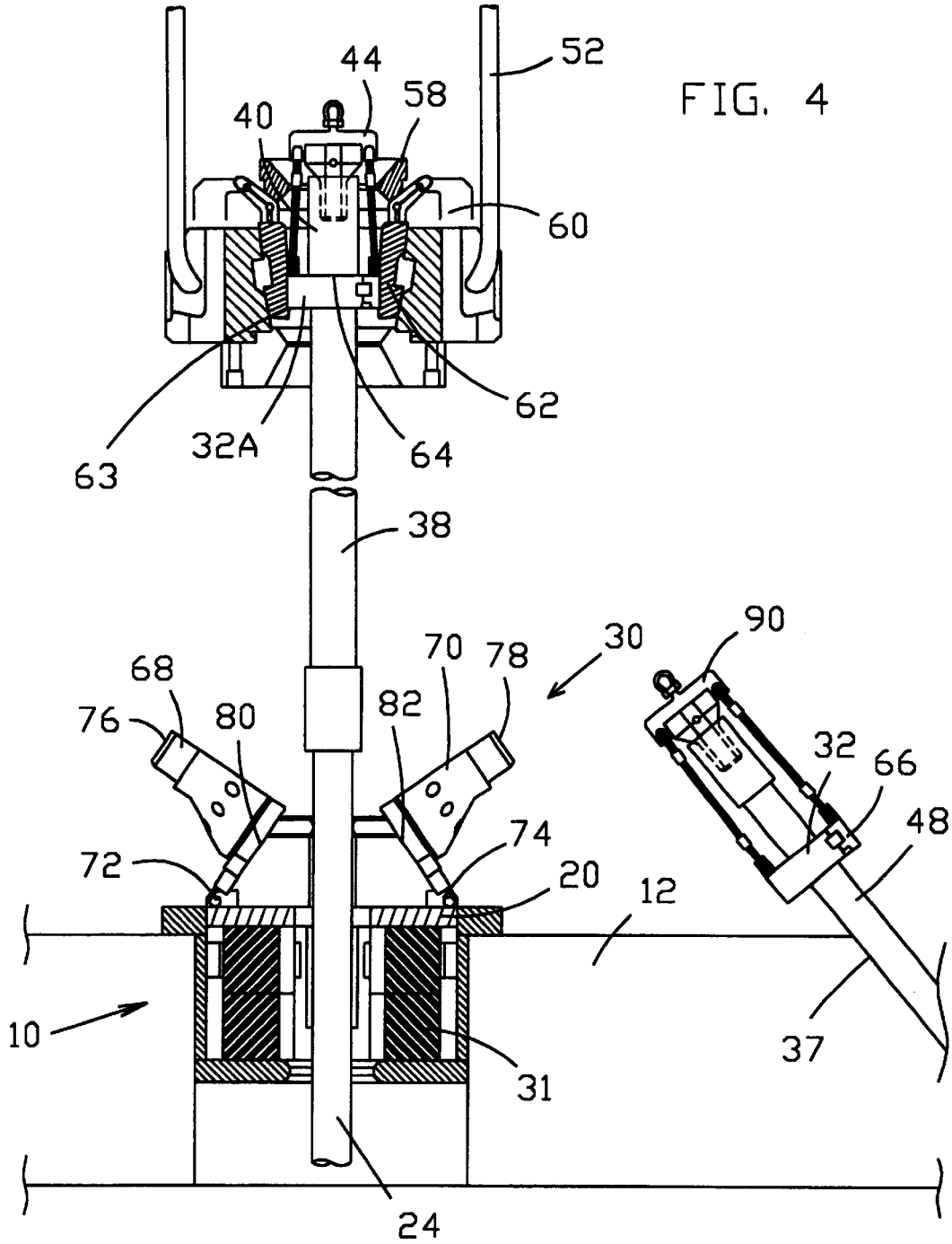
FIG. 4 is an elevational view, partially in section, of the landing spear separated and the string lowered into the wellbore.

In one embodiment, slips 62 are lowered into elevator body 50 creating inwardly radial movement of slips 62 to define a continuous load shoulder 63 as indicated in FIG. 4. As the driller lifts the traveling blocks, load transfer sleeve 32A is pulled into engagement with slips 62. Load transfer sleeve 32A moves upwardly with elevator 50 until it stops at lower face 64 of collar 40. As elevator 50 continues upward movement, the weight of wellbore tubular string 24 is now completely supported by elevators 50 through load transfer sleeve 32A engagement with lower face 64 of collar 40 so that wellbore tubular string 24 also moves upwardly. Compressible section 31 therefore also moves compression support 20 upwardly to the uncompressed position as shown in FIG. 4 from the compressed position as shown in FIGS. 1–3. Load transfer sleeve 32 may now be removed from wellbore tubular string 24 and secured to the next wellbore tubular such as wellbore tubular 48 which may be positioned on V-door 37. Load transfer sleeve 32 may preferably include hinge and latch mechanism 66 for attachment and removal of load transfer sleeve 32. Load transfer sleeve 32 is closely matched to the O.D. of the wellbore tubular to which it is attached such as wellbore tubular 48. The I.D. of load transfer sleeve 32 may be elastomer coated to prevent impact damage to the pipe body during installation on a pipe such as production tubing or casing. Preferably no radial loads are supported by hinge and latch mechanism 66 while wellbore tubular string 24 is supported by load transfer sleeve 32.

In a preferred embodiment, landing spear 30 is split into at least two sections 68 and 70 and are mounted to thereby open up or rotate with respect to each other such as by pivotal connections or hinges 72 and 74, respectively. In one presently preferred embodiment, hinges 72 and 74 are mounted to compression table 20. Because landing spear 30 opens up, larger collars, joints, valves, and the like are easily accommodated through landing spear 30 and shock table 10 in accord with the present invention. When sections 68 and 70 are closed, landing spear engagement ends 76 and 78 may engage the load transfer sleeve such as load transfer sleeve 32A. Base surfaces 80 and 82 are securely supported on compression table 20 when landing spear 30 is closed. While pivotal joints are preferred for automatic alignment purposes with the load transfer sleeve, other means for separating landing spear 30 could also be used such as slides, grooves, or the like. Preferably other separating means will also provide alignment with the load transfer sleeve when landing spear 30 is closed such as grooves, stops, or the like for quick and accurate alignment purposes. Pivotal joints or hinges may be provided between sections of landing spear 30 rather than between the shock table and the landing spear sections. Other types of connections could be used. The basic concept is that landing spear 30 moves or opens in some manner between a closed position wherein landing spear 30 is oriented and arranged to support the transfer sleeve and an open position wherein the landing spear sections are moved in such a way that large components can pass through landing spear 30 and shock table 10. Thus, the landing spear is not a restriction that limits the O.D. of items to pass through shock table 10. In one embodiment of the invention, load transfer sleeve 32 includes a counterbore (not shown) on the bottom side with sloping guide surfaces leading to the counterbore. The sloping guide surfaces lead direct ends 76 and 78 of landing spear 30 into the counterbore and thereby holds landing spear halves 68 and 70 together.

Figure 5:
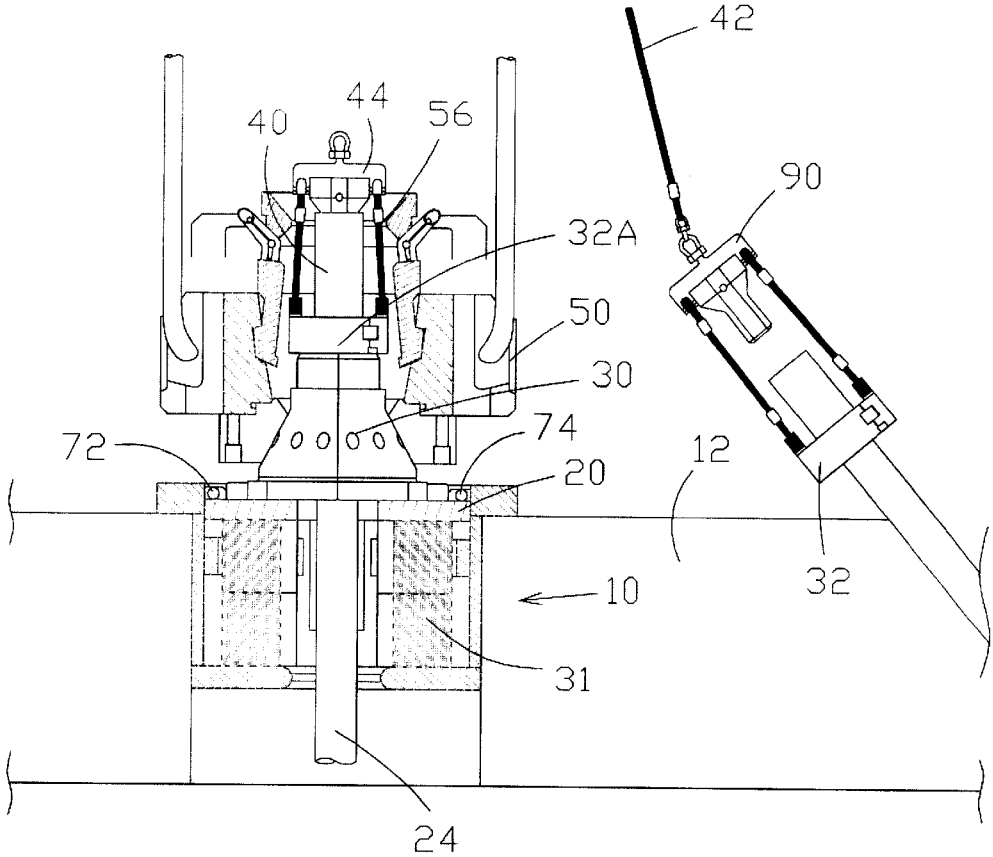
FIG. 5 is an elevational view, partially in section, of the landing spear being closed and the string being landed on the shock table; and While the present invention will be described in connection with the presently preferred embodiments, it will be understood that it is not intended to limit the invention to those embodiments. On the contrary, it is intended to cover all alternatives, modifications, and equivalents included within the spirit of the invention.

During the next phase of operation, landing spear 30 is closed, such as by pivoting the sections thereof, and elevators 50 are lowered so that the weight or load is transferred from elevators 50 to landing spear 30 via load transfer sleeve 32A as shown in FIG. 5. Upon receipt of weight of wellbore tubular string 24, landing spear 30 applies the weight to compression table 20, and compressible section 31 is compressed at the desired rate of compression for limiting dynamic forces. Elevator 50 may then release load transfer sleeve 32A and be raised upwardly. Hanger 44 and related slings 56 are removed, or set aside while still attached to load transfer sleeve 32A and the situation is the same as shown in FIG. 1. Another hanger 90 may be used with pick up line 42 for pulling the next joint of wellbore tubulars onto rig floor 12 for connection with wellbore tubular string 24.

Thus the present invention provides shock table 10 that is designed for mounting within the rig floor or rotary table so as to be largely out of the way. The shock table limits dynamic forces acting on the lower face of the coupling. The shock table may also provide a more accurately level surface of compression support 20 due to numerous compression cylinders for even spreading of forces. Landing spear 30 in accord with the present invention preferably opens easily to permit various size objects through the shock table. In a preferred embodiment, landing spear sections 68 and 70 are pivotally mounted to compression table 20 for easy opening as well as accurate and fast alignment with wellbore tubular string 24 and the corresponding load transfer sleeve such as load transfer sleeve 32 or 32A.

While the method is directed to inserting or running wellbore tubulars into the wellbore, the same method and equipment could be used, if desired, to remove wellbore tubulars from the wellbore, install or remove stands comprising multiple tubulars connected as a unit rather than single joints, or other variations of operation. Removing tubulars involves the reverse of the process discussed hereinbefore.

The foregoing disclosure and description of the invention is illustrative and explanatory thereof, and it will be appreciated by those skilled in the art, that various changes in the size, shape and materials, or the use of mechanical equivalents, or variations in the details of the illustrated construction or combinations of features of the invention may be made without departing from the basic concepts and/or spirit of the invention.

What is claimed is:

1. A handling system operable for holding and lowering wellbore tubulars for use with a rig having an elevator and a rig floor, said rig floor defining an opening therethrough, a plurality of collars for interconnecting said wellbore tubulars, said system comprising:

a sleeve for engaging said plurality of collars;

a landing spear for engaging said sleeve; and a shock table with a shock table body, at least a portion of said shock table body extending through said rig floor within said opening, said shock table enclosing a compressible section, a compressible surface supported by said compressible section, said compressible surface supporting said landing spear.

2. The handling system of claim 1, further comprising a radially outwardly extending member secured to one end of said shock table body for engagement with said rig floor and supporting said shock table within said opening.

3. The handling system of claim 2, wherein said radially outwardly extending member is a flange.

4. The handling system of claim 1, wherein said landing spear is pivotally mounted with respect to said compressible surface.

5. The handling system of claim 4, further comprising said landing spear being comprised of separable elements, each of said separable elements being pivotally mountable with respect to said compression surface.

6. The handling system of claim 1, further comprising said landing spear having a base for engagement with said compression surface, said landing spear having a conical profile.

7. The handling system of claim 1, further comprising said landing spear having an outer circumference and being split into at least two sections, each of said at least two sections forming a portion of said outer circumference.

8. The handling system of claim 7, wherein at least a portion of said landing spear has a conical profile.

9. The handling system of claim 7, further comprising a connection between each of said at least two sections and said compression table.

10. The handling system of claim 9, wherein said connection is a pivotal connection to permit pivotal movement between each of said at least two sections and said compression table.

11. The handling system of claim 1, further comprising a pivotal connection for opening said elevator.

12. The handling system of claim 1, further comprising slips movable within said elevator.

13. The handling system of claim 1, further comprising a plurality of clamps for attaching one or more lines to said wellbore tubulars.

14. A method for a wellbore tubular handling system for installing wellbore tubulars with respect to a wellbore, said wellbore tubular handling system being used with a derrick, said derrick having a rig floor, said rig floor having an opening therein, a plurality of collars for interconnecting said wellbore tubulars, said method comprising:

mounting a shock table within said opening in said rig floor such that at least a portion of said shock table is below a surface of said rig floor;

providing a landing spear for receiving a weight of said wellbore tubulars;

providing a compressible surface for said shock table such that said compressible surface is moveable with respect to said rig floor in response to tension applied thereto through said landing spear.

15. The method of claim 14, further comprising providing an enlarged portion of said shock table for engaging said rig floor and supporting said shock table within said opening in said rig floor.

16. The method of claim 14, further comprising providing a plurality of hinge connections for said landing spear.

17. The method of claim 14, further comprising pivotally interconnecting said landing spear with respect to said shock table.

18. The method of claim 14, further comprising moving each of a plurality of sections of said landing spear between an open position and a closed position.

19. The method of claim 18, further comprising rotating one or more of said plurality of sections of said landing spear between an open position and a closed position.

20. The method of claim 14, further comprising opening an elevator.

21. The method of claim 14, further comprising moving slips within an elevator.

22. The method of claim 14, further comprising attaching one or more lines to said wellbore tubulars.

23. A wellbore tubular handling system for installing wellbore tubulars in a a wellbore, said wellbore tubular handling system being supported by a rig, said rig having a rig floor, said rig floor defining an opening therethrough, a plurality of collars for interconnecting said wellbore tubulars, said system comprising:

a shock table at least partially mountable below said rig floor;

a compressible surface for said shock table, said compressible surface being movable with respect to said shock table and said rig floor for supporting said weight of said wellbore tubulars;

a landing spear for supporting a weight of said wellbore tubulars transferred to said landing spear from respective of said plurality of collars, said landing spear having at least two sections, each of said at least two section being mounted for movement with said compressible surface, said at least two sections being moveable with respect to said shock table between a closed position and an open position whereby in said closed position said landing spear is operable for supporting said weight of said wellbore tubulars, and in said open positions said at least two sections are spaced apart relative to each other.

24. The handling system of claim 23, further comprising one or more pivotal connections for said at least two sections.

25. The handling system of claim 24, wherein said one or more pivotal connections connect between each of said at least two section and said compressible surface.

26. The handling system of claim 24, wherein said one or more connections further comprise one or more rotatable connections for rotation between said compressible surface and said at least two sections.

27. The handling system of claim 23, further comprising an elevator with a pivotal element for opening said elevator.

28. The handling system of claim 23, further comprising an elevator supporting moveable slips mounted therein.

29. The handling system of claim 23, further comprising a plurality of clamps for attaching one or more lines to said wellbore tubulars.

30. A method for a handling system for wellbore tubulars, comprising:

suspending a wellbore tubular string by supporting a weight of said wellbore tubular string on a downward face of an upper collar of said wellbore tubular string, said weight of said wellbore tubular string being received by a landing spear, said landing spear having a plurality of landing spear sections;

mounting said landing spear to a compressible support surface, said compressible support surface compressing in response to said weight of said wellbore tubular string at a selected rate of compression;

mounting a shock table body for supporting said compressible support surface such that at least a portion of said shock table body is mounted beneath a rig floor;

lifting an additional wellbore tubular for attachment to said wellbore tubular string;

stabbing a pin end of said additional wellbore tubular into said upper collar;

making said pin end and said upper collar connection tight;

lifting said wellbore tubular string; and opening said landing spear by moving one or more of said plurality of landing spear sections radially outwardly with respect to said wellbore tubular string.

31. The method of claim 30, further comprising pivoting one or more of said plurality of landing spear sections.

32. The method of claim 30, further comprising rotating said plurality of spear sections in different rotational directions for opening said landing spear.

33. The method of claim 30, further comprising moving slips in an elevator.

34. The method of claim 30, further comprising opening an elevator.

35. The method of claim 30, further comprising attaching one or more lines to said wellbore tubulars.

* * * * *